US006508043B1

(12) United States Patent
Bond et al.

(10) Patent No.: US 6,508,043 B1
(45) Date of Patent: Jan. 21, 2003

(54) BUILDING CONSTRUCTION SYSTEM AND METHOD

(76) Inventors: Art Bond, 7400 SW. 4th St., Plantation, FL (US) 33317; John Poffenbarger, 1642 NW. 104th Ave., Coral Springs, FL (US) 33071

( * ) Notice: Subject to any disclaimer, the term of this patent is extended or adjusted under 35 U.S.C. 154(b) by 0 days.

(21) Appl. No.: 09/502,396

(22) Filed: Feb. 11, 2000

(51) Int. Cl.[7] ..... E04B 1/04

(52) U.S. Cl. ..... 52/742.14; 52/745.09; 52/449; 52/414; 52/299; 52/284; 52/274

(58) Field of Search ..... 52/223.6, 274, 52/284, 293.1, 294, 299, 375, 414, 449, 450, 556, 600, 602, 741.13, 742.14, 741.41, 745.09

(56) References Cited

U.S. PATENT DOCUMENTS 867,251 A * 10/1907 Davis ..... 52/354
1,378,928 A * 5/1921 Witzel ..... 52/223.6
2,052,113 A * 8/1936 Ruppel ..... 52/657
2,261,480 A * 11/1941 Morrell ..... 52/354
2,655,710 A * 10/1953 Roensch et al. ..... 264/87
2,695,159 A * 11/1954 Bridwell ..... 52/293.1 X
3,747,287 A * 7/1973 Finger ..... 52/18
3,800,493 A * 4/1974 Livingston ..... 52/745.03
3,872,636 A * 3/1975 Nicosia ..... 52/364
4,145,861 A * 3/1979 Yarnick ..... 52/741.15
5,033,248 A * 7/1991 Phillips ..... 52/742.14
5,335,472 A * 8/1994 Phillips ..... 52/742.14
5,987,827 A * 11/1999 Lord ..... 52/274
6,076,319 A * 6/2000 Hendershot et al. ..... 52/271

* cited by examiner

*Primary Examiner*—Carl D. Friedman
*Assistant Examiner*—Brian E. Glessner
(74) *Attorney, Agent, or Firm*—Malloy & Malloy, P.A.

(57) ABSTRACT

A building construction system including a pair of rigid vertical frame members secured to an underlying support surface, a connection trough defined between the vertical frame members, a horizontal suspension member also extending between the vertical frame members and suspended at generally a top portion thereof, and a plurality of corrugated material panels. The corrugated material panels are suspended from the horizontal suspension member, so as to hang between the vertical frame members and into the connection trough. Furthermore, the corrugated material panels include a plurality of apertures defined therein. A quantity of concrete is also included and is applied on the corrugated material panels, the apertures defined in the corrugated material panels facilitating adherence of the concrete to the corrugated material panels until hardening. The concrete is also structured to be dispensed into the connection trough and to harden therein to define a footer of the wall member defined by the hardened concrete on the corrugated material panels.

6 Claims, 3 Drawing Sheets

BUILDING CONSTRUCTION SYSTEM AND METHOD

BACKGROUND OF THE INVENTION

1. Field of the Invention

The present invention relates to a building construction system and method specifically utilized to rapidly and economically construct building structures, such as a house. The system and method are particularly suited for rapid and convenient transport of all necessary components to a particular installation or building site, such as in a kit format, with the building structure produced being substantially sturdy and durable despite its installation versatility and ease of utilization and construction.

2. Description of the Related Art

As can be appreciated, the need for affordable housing and other building structures is ever increasing in the United States and throughout the world. Furthermore, although conventional building techniques are well established and are generally effective for constructing traditional building structures, there is still a need in the art for a system and method for fabricating a building structure which is cost effective to implement and can be quickly and easily utilized so as to construct a desired building structure, without compromising durability and versatility.

Certainly, others in the past have attempted to construct modular building type systems, such as those conventionally referred to as panel housing and the like, wherein less expensive, light weight components are utilized so as to construct a basic building structure. Unfortunately, however, such building structures, while being less costly and generally transportable, are often generally flimsy and do not provide sufficient strength and durability for a long term application. Moreover, such conventional low cost housing systems are often difficult to expend and/or adapt to meet varying needs, and typically still require the utilization of some traditional, costly building techniques if a truly stable and durable structure is to be provided.

Additionally, it is recognized that among the prior types of low cost construction systems, others in the past have attempted to utilize mesh type corrugated panels for the purpose of spray on concrete wall formation. Unfortunately, even such structures, which provide for the use of suspended panels, have a number of drawbacks associated with their conventional construction and use. For example, prior art corrugated panel wall construction often required bracing and/or reinforcement as the wall structure is typically a free standing configuration disposed in overlying relation on the ground. Along these lines, such systems typically require the formation of a traditional foundation footing and/or the positioning of support track or the like so as to receive and maintain walls in their vertical orientation. Furthermore, conventional designs often have a significant draw back in connection with the formation of window and door openings, requiring the chiseling and/or other removal of concrete in order to create such openings after construction of a wall. Also, with such construction systems, as with most other commercially available low cost and easily stored construction system, the need for traditional roof truss system along the entire the length of the roof and in particular at opposite ends of the building structure cannot be avoided, thereby adding considerable cost in materials and labor to the overall housing structure, and often requiring specialize skills to completely install.

Accordingly, there is still substantial need in the art for an affordable yet effective building construction system and method, that not only can be transported to an installation site in a compact and convenient manner, but which can also be erected efficiently, effectively and rapidly. Furthermore, such a system should not merely assemble a flimsy, temporary building, but rather should be configured so as to construct a sturdy, well made and versatile building, that is durable and adaptable for a variety of uses in a variety of different configurations.

SUMMARY OF THE INVENTION

The present invention relates to a building construction system configured to provide for the effective construction of various building structure in a cost effective and rapid manner. In particular, the construction system includes at least two, and typically at least four vertical frame members. Specifically, the vertical frame members are preferably substantially rigid, and are secured to an underlying support surface in a spaced apart relation from one another. Extending between adjacent ones of the vertical frame members are horizontal suspension members. The horizontal suspension members, which are preferably relatively light weight, yet rigid and somewhat sturdy, are preferably secured at generally a top portion of the corresponding vertical frame members.

The system and kit of the present invention further includes a plurality of corrugated material panels. In particular, the corrugated material panels are preferably constructed from a metal mesh type material, and as such can be transported to the installation site in a collapsed, compact format, and expended for effective use. The corrugated material panels are structured to be secured from the horizontal suspension members in a generally hanging, or suspended manner. Furthermore, the corrugated material panels are preferably structured to hang and extend into a connection trough that is preferably defined between adjacent vertical frame members. Specifically, the connecting trough preferably includes a depth that extends below the plane of the underlying support surface, and as a result the corrugated material panels are preferably generally longer than the distance from the horizontal suspension members to the underlying support surface so as to effectively hang into the connection trough.

The system of the present invention further includes a quantity of concrete. In particular, the quantity of concrete is structured to be applied to the first and second sides of the corrugated material panels. Moreover, the corrugated material panels preferably include a plurality of apertures defined therein which facilitate the adherence of the concrete to the corrugated material panels. The concrete is also structured to be applied into the connecting trough. As a result, upon hardening of the concrete, an integral wall member with a solid and sturdy footer is generally defined and extends down into the connection trough.

Additionally, if desired, at least one or two of the horizontal suspension members may include a generally peaked configuration. As such, the formed wall member includes a generally peaked header portion which can act as a roofing truss, such as an end of the building structure.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
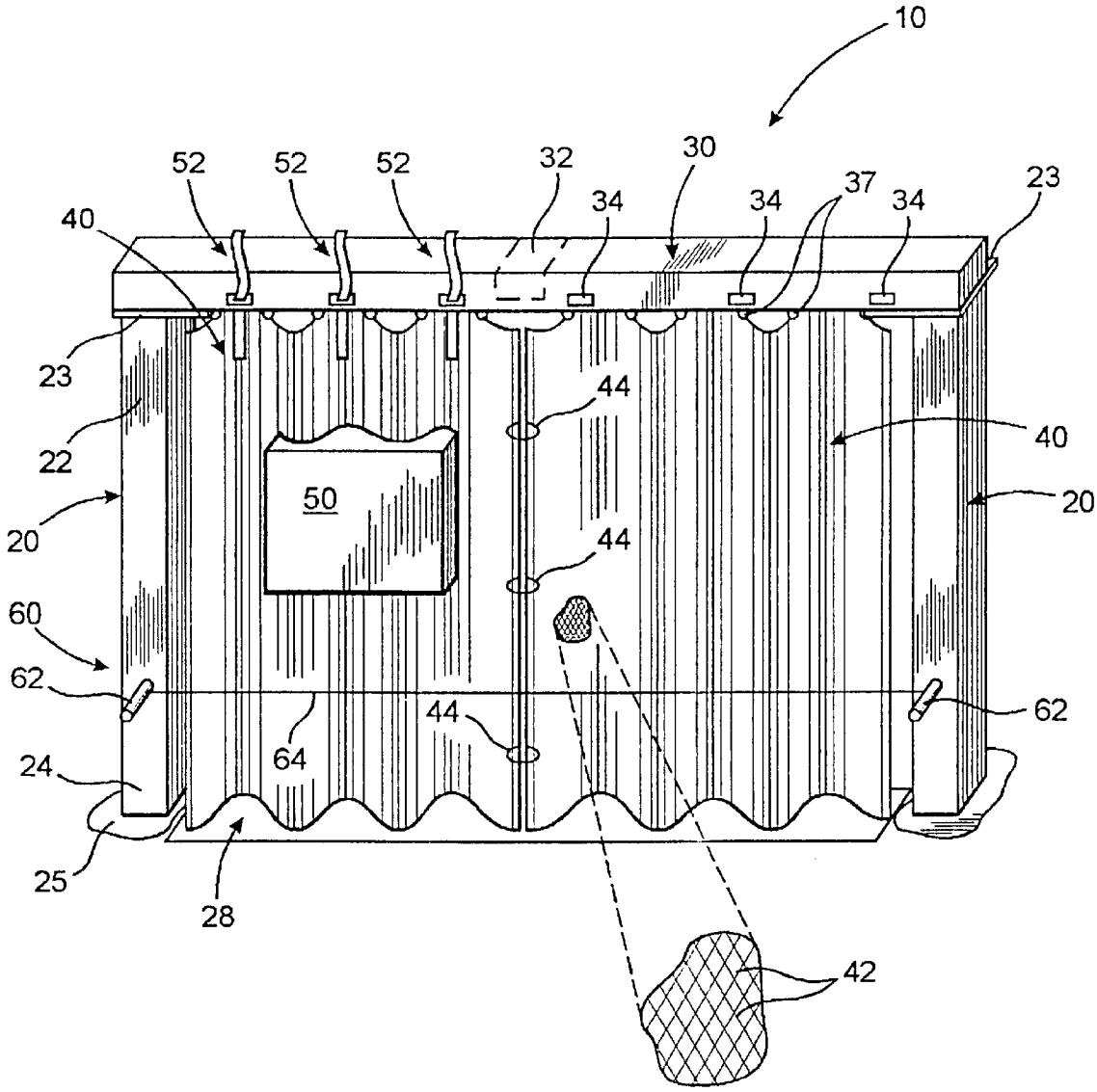
FIG. 1 is an isolated perspective view of the building construction system of the present invention prior to application of concrete, and utilized for the construction of a single wall member.

Shown throughout the Figures the present invention is directed towards a building construction system, generally indicated as 10. In particular, the building construction system 10 is preferably configured so as to be able to comprise a modular, transportable construction kit type structure, which can be substantially easily provided at a particular building site and has the capability of being expandable into a variety of different configurations depending upon the particular needs for a particular building. Along these lines, it is recognized that the building to be constructed may include a house, storage facility and/or any other type of building structure of the type which typically includes a series of walls and a roof.

Looking particularly to the building construction system 10 of the present invention, it includes preferably at least two vertical frame members 20. Along these lines, it is recognized that when constructing a standard four wall building structure, preferably at least four vertical frame members 20 will be utilized to complete an enclosure. For purposes of illustration, however, reference will be made to the present inventive structure utilized to construct a single or pair of wall members, each having two vertical frame members 20. It is, of course, recognized that even in the construction of a single wall member, additional vertical frame members may be provided and interposed between two perimeter frame members 20.

Each of the vertical frame members 20 preferably includes a substantially rigid, strong configuration, and is preferably defined from a rigid metal or other strong, durable material construction. Furthermore, each of the frame members 20 is preferably secured to an underlying support surface so as to be maintained in its vertical, supporting orientation. In this regard, and especially in an embodiment wherein the underlying support surface comprises the ground at an installation site, a lower end 24 of the vertical frame member 20 may be recessed into an opening defined in the underlying support surface, and a quantity of concrete 25 may be disposed therein so as to harden and thereby effectively secure the vertical frame member 20 in its vertical orientation.

Suspended, preferably between adjacent ones of the vertical frame members 20, is at least one horizontal suspension member 30. The horizontal suspension member 30 preferably includes a generally rigid construction, however, based upon the system and method of the present invention, the horizontal suspension member 30 can be made from a generally lighter weight metal or other type of material as it will not generally define a load bearing component of the finished building structure, by itself. Preferably, opposite ends of the horizontal suspension member 30 are secured at generally a top portion 22 of each of the vertical frame members 20. Furthermore, in the illustrating embodiment of the present invention the vertical frame members 20 preferably include a ledge type structure 23 defined at the top portion 22 thereof. Specifically, the ledge 23 provides a wider surface area atop which the horizontal suspension member 30 may be supportingly disposed. Moreover, it is also preferred that conventional securement, such as through a bolt, nails, screws, welding, adhering, etc., be provided so as to firmly secure the horizontal suspension member 30 atop the vertical frames member 20.

The present invention further includes at least one, but preferably a plurality of corrugated material panels 40. The corrugated material panels 40 are preferably formed from an extruded metal mesh and as such include a first side and a second side, such as representing the exterior and interior portions of a wall member 80. Furthermore, preferably as a result of the meshed configuration, although it is understood that a stamped or other type configuration could be utilized, a series of apertures 42 are preferably defined in the corrugated material panels 40, those aperture 42 preferably extending from the first side through the second side of the corrugated material panels 40. It is also recognized that the corrugated nature of the corrugated material panels 40 is preferably defined by the fact that a general trough type configuration is defined on the sides of each material panel 40. Of course, while a zig-zag configuration is illustrated and is most common, a channel type of configuration and/or rounded or wavy type configuration may be provided, the preferred characteristic being the existence of trough like demarcations or indentations on each side so as to retain concrete, as will be described. Also, it is recognized that the corrugated nature of the corrugated material panels 40 facilitates the collapsing, such as in an accordion type folding, thereby facilitating transport and subsequent expansion at the installation site for effective utilization. As such, one or more large panels, and/or a series of smaller panels can be provided and, if desired secured to one another, such as utilizing a series of compressible c-shaped clips 44.

The corrugated materials panel 40 are preferably structured to be suspended from the horizontal suspension member 30. This can be achieved by any of a variety means, including the use of a series of clips 37 that extend between corrugated material panels 40 and the horizontal suspension member 30, or by hooks, nails, clamps, ties, etc. Additionally, the suspension of the corrugated material panels 40 is preferably generally vertical, with a typical hanging type of suspension being generally acceptable. Along these lines, in some instances a bracing configuration may be desirable so as to maintain the generally vertical orientation, on at least a temporary basis, as the remainder of the building construction system 10 is implemented.

In order to define a sturdy and strong wall member, the present invention further includes a quantity of concrete. Specifically, the concrete may be any type of conventional concrete type building material or another conventional equivalent building material, which has a generally fluid configuration when mixed, and subsequently will harden into a solid, sturdy configuration. The concrete is structured to be applied directly to the corrugated material panels 40, and preferably on both the first and second sides of the corrugated material panel 40. As a result, the concrete will generally fill the troughs defined by the corrugated material configuration of the material panels 40. Furthermore, as a result of the apertures 42 defined in a corrugated material panels 40, the concrete has a tendency to generally pass through the apertures 42 and will better adhere and/or cling to the corrugated material panels 40 when still in its fluid state and while hardening. Preferably, the concrete will be applied to a uniform depth along the entire first side of all corrugated material panels 40 that defined the wall members 80, as well as the second sides thereof. Further, the concrete can be applied manually, or as may be preferred, can be sprayed on by mechanical means.

In order to ensure that substantially smooth and generally uniform wall members are defined, the present construction system also preferably includes a depth guide assembly, generally 60. Specifically, the depth guide assembly 60 is provided so as to achieve a generally uniform depth across the entire surface of the formed wall members 80. In the illustrated embodiment the depth guide assembly 60 preferably includes at least one rigid indicator segment 62. The rigid indicator segment 62 preferably includes a generally elongate pin, and preferably one of the rigid indicator segments 62 is secured in a general perpendicular orientation to each vertical frame member 20. The depth guide assembly 60 also preferably includes a guide element 64. In the illustrated embodiments, the guide element 64 includes an elongated wire that is secured to the rigid indicator segments 62 on adjacent frame members 20, so as to generally span from one frame member 20 to another at the desired depth. Of course, it is recognized that although in the illustrated embodiment only two of the rigid indicator pins 62 are provided, one on each adjacent vertical frame member 20, with only a single guide element 64, a more elaborate array, including a larger number of rigid indicator segment 62 and/or guide elements 64 may be provided. Additionally, when the vertical frame members 20 define a corner, it may include two rigid indicator pin segments 62, one perpendicularly expending from each exterior plane of the building structure, or a single, corner extending, rigid indicator segment 62. The guide segment 64 of the depth guide assembly is preferably structured to define a scraping plane through which a scraping article may be passed so as to remove excess quantities of concrete from the corrugated material panels 40 prior to hardening. For example, a larger planer element, such as a board or metal sheet may be provided and is configured to generally pass over or under the one or more wires that defines the guide element(s) 64, thereby maintaining a uniform depth as the scraping article is passed over the applied concrete. If desired, an interlocking type of arrangement can be provided between the scraping article and the guide element 64, such that guide element 64 generally rides in or in association with the scraping article. In any such embodiment, however, excess concrete is generally removed, and can be positioned directly in the connection trough 28, or can be removed for discarding or re-use. Therefore, when the concrete hardens, a generally uniform rigid wall member 80 is defined.

As previously mentioned, a connection trough 28 is preferably disposed between adjacent vertical frame members 20. In this regard, the connection trough 28, much like the corrugated material panels 40, can extend to completely span substantially the entire distance from one vertical frame member 20 to the adjacent one, or a lesser distance can be defined. The connection trough 28 is preferably, however, defined into the underlying support surface, such that the corrugated material panels 40 hangs down into the connection trough 28. Along these lines, when the concrete is applied to the corrugated material panels 40, it is also preferably applied into the connection trough 28, preferably filing it to at least a plane of the underlying support surface and/or another desired, defined plane. As such, when the concrete hardens, a uniform and preferably integral wall member 80 with a footer 82 defined inside the connection trough 28 is preferably formed, thereby providing substantial stability and security for the wall member 80 in its final formed state. Also, from this it is noted that the formed wall member 80 provides a solid load bearing element. For that reason, the horizontal suspension members 30 need not solely and/or directly have to support a heavy load, and can be made from a less strong material. Additionally, as will be described in greater detail subsequently, if a portion of the horizontal suspension member 30 is cut, such will not compromise the structural integrity and strength of the building structure that is defined.

It is recognized that when forming a majority of building structures, it is also preferably to have one or more opening defined therein. There openings may include conduits, windows, doors and/or the like types of openings that allow access to the interior of a building structure that is defined, and/or to merely allow for the installation of another article, such as a conduit, window frame, door frame, and the like. In order to facilitate the uniform and even formation of such an opening, the present invention also preferably includes at least one, but preferably a plurality of opening templates 50. The opening templates 50, which may be formed from, Styrofoam™ or other easily removable plastic, wood, metal or another material are preferably removably secured to the corrugated material panels 40 at a location wherein a window opening, door opening or other desired opening is to be defined. Of course, it may be preferably to secure a corresponding portion of an opening template to secure a corresponding portion of an opening template 50 on both the first and second sides of the corrugated material panels 40, although only a single side may be sufficient so as to effectively and at least partially define the opening in the formed wall member 80. The opening template 50 is preferably structured to be completely removable from the wall member 80, at least once the concrete that defines the wall member 80 has effectively hardened. As such, when the opening template 50 is removed, the corrugated material panel portion 52 there beneath is generally exposed and can be cut so as to completely defined the opening. Indeed although the opening can be cut in the corrugated material panel 40 before the application of concrete, it may be preferred to cut the corrugated material panel while the concrete is being applied and hardened to form the wall member 80.

As mentioned, based upon the structural integrity that is defined by the wall member 80 itself, the horizontal suspension member 30 may be cut if necessary. Preferably, this cutting of the horizontal suspension members 30 can take place after hardening of the concrete, and is particularly suitable so as to accommodate positioning of a traditional roofing truss 70 on the wall member 80, if necessary. In order to facilitate rapid fabrication of the building structure, a cut indicator 32, such as indicia, markings and/or a partial pre-cut can be pre-defined in a portion of horizontal suspension member 30, thereby clearly indicating what must be cut once the concrete has hardened. As such, by removing that portion of the horizontal suspension member 30, a gap or notch 33 may be defined therein where a more traditional roofing truss 70 may be disposed and be supported by the wall member 80.

Figure 2:
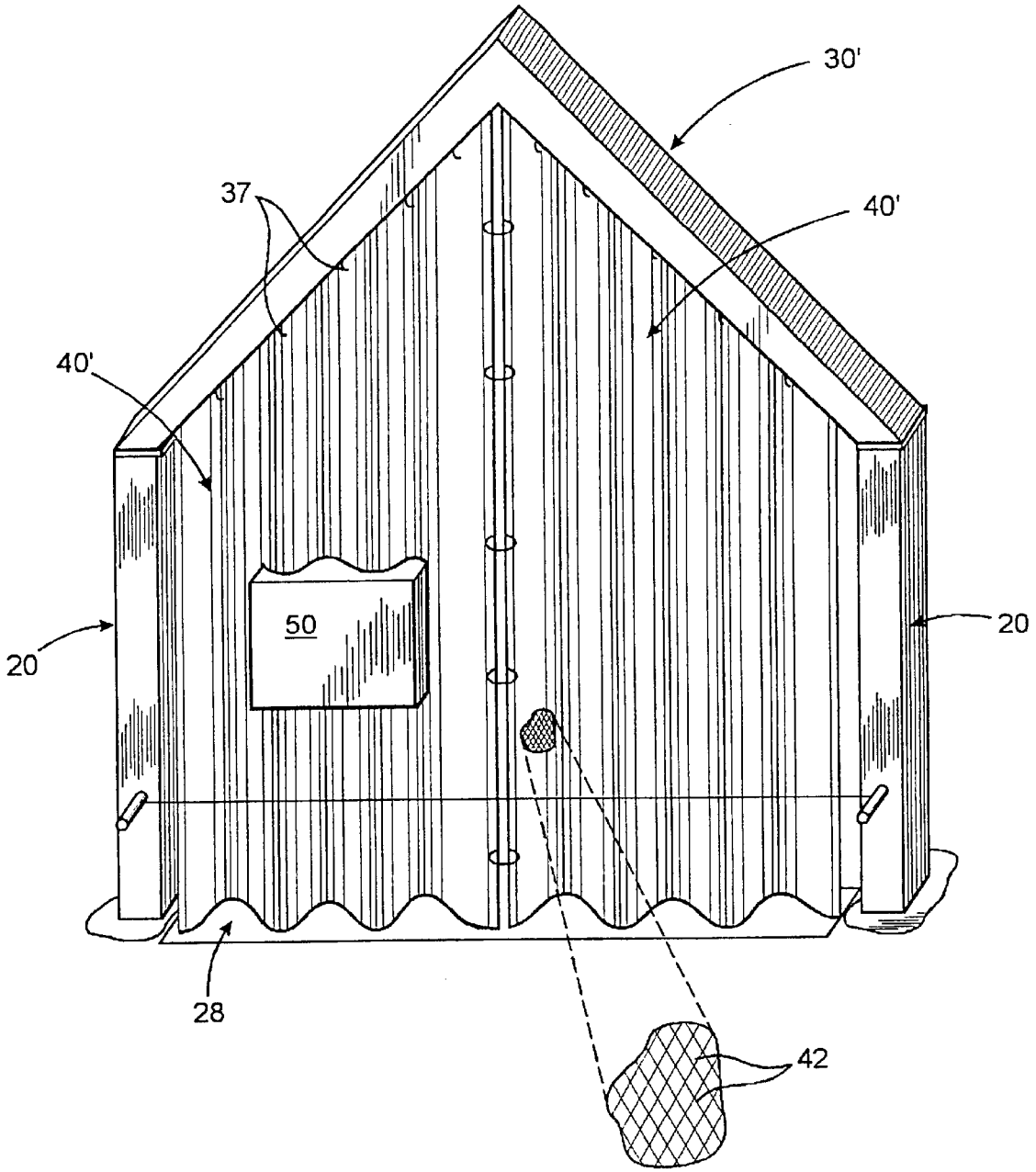
FIG. 2 is a partial perspective illustration of a building construction system of the present invention illustrating the peaked horizontal suspension member.

In addition to a traditional roofing truss 70 that may be positioned, if necessary, at a central portion of the building structure, in the illustrated embodiment of the present invention, the traditional roofing trusses are preferably not utilized at opposite ends of the building structure, and in particular over a plane of a formed wall member 80'. In particular, the horizontal suspension member 30' may, if desired, include a generally peaked configuration, as illustrated in FIG. 2. This peaked horizontal suspension member 30' is preferably secured in substantially the same fashion to the vertical frame members 20, and the corrugated material panels 40' are also suspended therefrom. In such an embodiment, however, the corrugated material panels 40' also preferably include a generally matching peaked configuration so as to generally fill in the area beneath the horizontal suspension member 30'. As such, when the concrete is applied and subsequently hardened, the wall member 80' defined thereby will generally include an upper truss header portion 84 that matches the shape and the desired configuration of the roofing trusses to be utilized on the particular building structure. In such an embodiment, the wall member 80' acts as the roofing truss when a peaked roof is desired, and the number of often heavier, more costly traditionally roofing trusses 70 is reduced.

Figure 3:
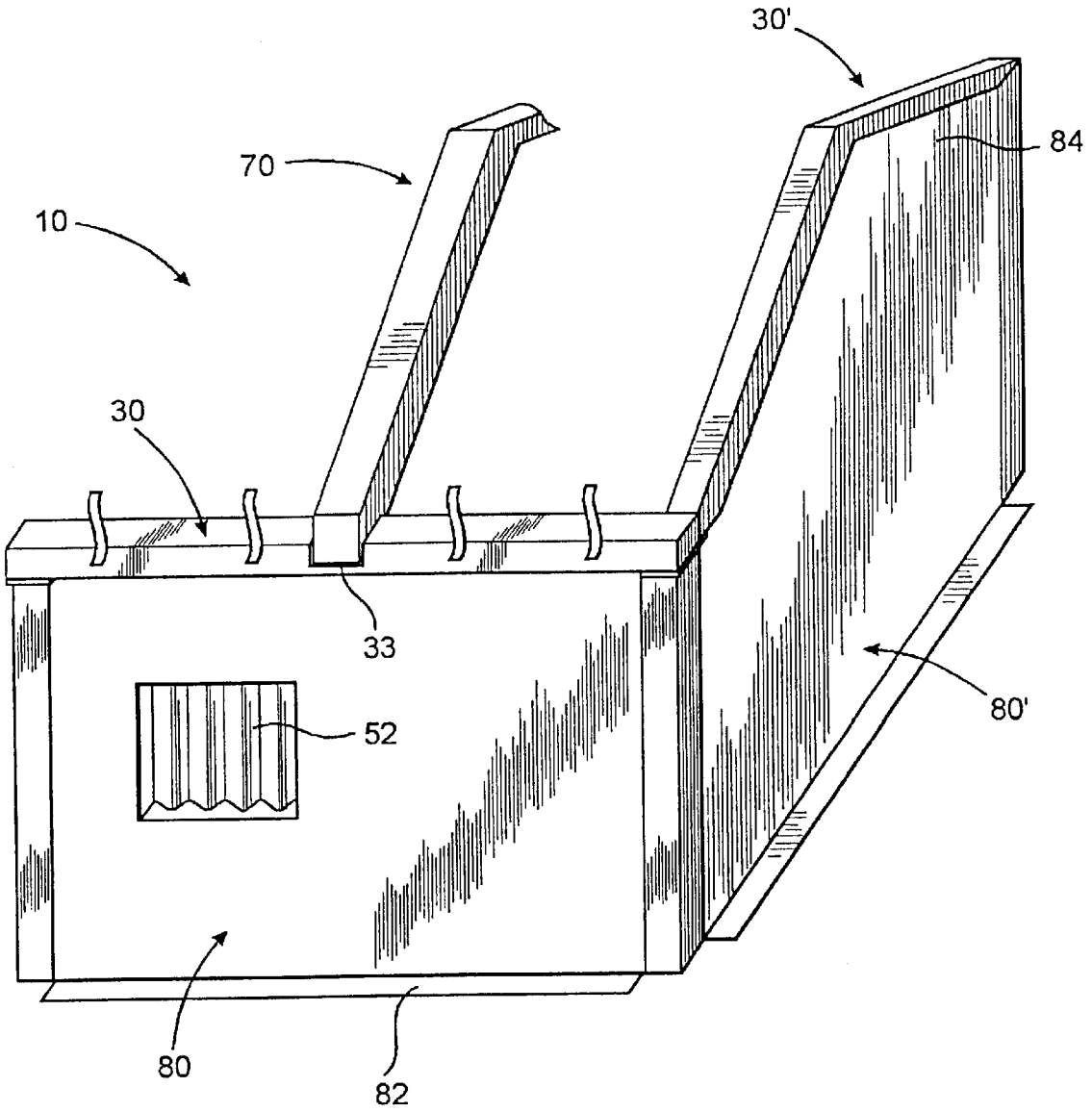
FIG. 3 is a partial perspective illustration illustrating formed wall members utilizing the building construction system and method of the present invention.

Additionally, as shown in FIGS. 1 and 3, a plurality of hurricane straps 52 may also be provided so as to further secure the defined wall members 80, 80' to any further roofing or second story structure formed on top of the building structure. Specifically, the hurricane straps 52 are preferably secured to the corrugated material panel 40, such as utilizing clips, rivets, bolts, etc., and such that a portion of the hurricane straps 52 extend beyond and preferably above the corrugated material panels 40. As a result, when the concrete hardens to define the wall members 80', 80' the hurricane straps 52 extend therefrom and are actually embedded in the wall member 80, 80' providing secure, integral engagement therewith. In this regard, it is also noted that because the horizontal suspension members 30 preferably do not define a load bearing portion, a plurality of strap apertures 34 are preferably defined therein so as to accommodate passage of the protruding portions of the hurricane straps 52 therethrough for subsequent fastening as needed. Similarly, any other component to be utilized within the building structure, such as plumbing and/or wiring conduit can also be pre-secured to the corrugated material panels 40 and will thereby be embedded directly in the concrete that defines the wall members 80, 80', as desired for the particular building structure being defined.

From the preceding, it is recognized that the present invention is also directed towards a method of constructing a building structure. Specifically, the method includes preferably an initial step of securing at least two, and possibly more, vertical frame members 20 in a vertical orientation into an underlying support surface. Next, a horizontal suspension member 30 is preferably suspended between adjacent vertical frame members 20, at least one corrugated material panel 40 in turn being suspended from the horizontal suspension member 30. Additionally, preferably defined between the vertical frame members 20 is a connection trough 28, the trough 28 being formed into an underlying support surface and/or possibly lined, if desired. Once suspended, the corrugated material panel 40 preferably extends into the connection trough 28.

At this point, if desired, one or more opening templates 50 may be secured to the material panels 40 in order to define an opening for the building structure. Similarly, one or a plurality of hurricane straps may be secured to the corrugated material panels 40, with a portion thereof extending above and/or beyond the corrugated material panel's surface. Once those elements, and any other elements such as conduits, other reinforcement structures and the like are secured to the corrugated material panel 40, a quantity of concrete is then applied, preferably to both a first and second side of the corrugated material panels 40. Also, the concrete is preferably applied into the connection trough 28 itself. Prior to the concrete hardening, an elongated guide element is extended between rigid indicator segments. In particular, the rigid indicator segments are preferably secured to adjacent vertical frame members 20. A scraping article is than passed over the concrete, that has been applied to the corrugated material panel 40, in alignment with the guide element. As a result, excess quantities of the concrete are removed and a substantially uniform wall member surface is defined, the concrete is then allowed to harden so as to define the wall member 80, the wall member also including an integral footer 82. In an embodiment wherein a traditional roofing truss will be disposed on the assembly, a portion of the horizontal suspension member 30 is then cut and removed, defining a gap 33 therein. The traditional roof truss 70 is then secured to the wall member 30, and possible using one or more of the hurricane straps 52, as desired.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended

What is claimed is:

1. A method of constructing a building structure comprising:

securing at least two vertical frame members in a vertical orientation into an underlying support surface;

defining a connection trough into the underlying support surface between said vertical frame members;

suspending a horizontal suspension member between said vertical frame members;

defining at least one material panel including a plurality of apertures defined therein and structured to retain a quantity of un-hardended concrete thereon when disposed in a vertical orientation;

suspending said material panel from said horizontal suspension member;

positioning a lower portion of said material panel within said connection trough such that said material panel is spaced from an exterior edge and an interior edge of said connection trough;

applying a quantity of concrete onto said material panel from both a first and a second side thereof until said concrete substantially contains said material panel;

dispensing a further quantity of said concrete into said connection trough so as to contain said lower portion of said material panel; and allowing said concrete to harden so as to define a wall member including an integral footer.

2. A method of construction as recited in claim 1 further comprising the steps of:

securing at least one opening template to said material panel prior to complete application of said quantity of concrete to said material panel;

removing said opening template after said concrete has hardened so as to expose said material panel; and cutting said exposed material panel so as to define an opening in said wall member.

3. A method of construction as recited in claim 1 further comprising the steps of:

cutting and removing a portion of said horizontal suspension member so as to define a gap therein after hardening of said concrete; and securing a roof truss to said wall member at said gap in said horizontal suspension member.

4. A method of construction as recited in claim 1 further comprising the steps of:

securing at least one rigid indicator segment to each of said vertical frame members;

extending at least one elongate guide element between said rigid indicator segments; and passing a scrapping article over said concrete applied to said material panel, prior to hardening thereof and in alignment with said guide element, so as to remove excess quantities of said concrete and define a substantially uniform wall member surface.

5. A method of construction as recited in claim 1 further comprising the step of securing a plurality of hurricane straps to said material panel, prior to application of said quantity of concrete, with an end portion of said hurricane straps extending beyond said material panel.

6. A building construction system comprising:

at least two vertical frame members, said vertical frame members being substantially rigid and being secured to an underlying support surface;

a connection trough defined between said vertical frame members in the underlying support surface;

a horizontal suspension member extending between said vertical frame members;

at least one material panel disposed in a suspended orientation between said vertical frame members and extending into said connection trough such that said material panel is spaced from an exterior edge and an interior edge of said connection trough;

a quantity of un-hardended concrete disposed on said material panel;

said material panel including a plurality of apertures defined therein from a first side to a second side thereof and structured to receive said un-hardened concrete on both said first side and said second side thereof;

said apertures being structured and disposed to receive said un-hardened concrete at least partially there-through and-to thereby help retain said un-hardended concrete on said material panel when said material panel is disposed in said suspended orientation so as to define a wall member upon hardening thereof; and said connection trough further receives a quantity of said un-hardened concrete therein defines a wall footer integral with said wall member.

* * * * *